US011636992B2

(12) United States Patent
Otsuka et al.

(10) Patent No.: US 11,636,992 B2
(45) Date of Patent: Apr. 25, 2023

(54) ELECTROMAGNETIC RELAY INCLUDING FIXED TERMINAL HAVING CHAMFERED SHAPE OR MOVABLE CONTACT PIECE HAVING CHAMFERED SHAPE

(71) Applicant: OMRON Corporation, Kyoto (JP)

(72) Inventors: Kohei Otsuka, Omuta (JP); Ryota Minowa, Yamaga (JP); Hiroyuki Iwasaka, Kumamoto (JP); Yasuo Hayashida, Kumamoto (JP); Shingo Mori, Yamaga (JP); Naoki Kawaguchi, Yame (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 17/297,459

(22) PCT Filed: Oct. 17, 2019

(86) PCT No.: PCT/JP2019/040810
§ 371 (c)(1),
(2) Date: May 27, 2021

(87) PCT Pub. No.: WO2020/137106
PCT Pub. Date: Jul. 2, 2020

(65) Prior Publication Data

US 2022/0051863 A1 Feb. 17, 2022

(30) Foreign Application Priority Data

Dec. 28, 2018 (JP) ..... JP2018-246970

(51) Int. Cl.
*H01H 50/38* (2006.01)
*H01H 50/54* (2006.01)

(52) U.S. Cl.
CPC ..... *H01H 50/38* (2013.01); *H01H 50/54* (2013.01)

(58) Field of Classification Search
CPC ..... H01H 50/38; H01H 50/54; H01H 1/06; H01H 9/443
See application file for complete search history.

(56) References Cited

U.S. PATENT DOCUMENTS 3,082,307 A * 3/1963 Greenwood ..... H01H 33/664 218/123
3,163,734 A * 12/1964 Lee ..... H01H 33/66261 313/313

(Continued)

FOREIGN PATENT DOCUMENTS

CN 104347314 B * 9/2016 ..... H01H 50/38
JP 8-69738 A 3/1996

(Continued)

OTHER PUBLICATIONS

The International Search Report of International Application No. PCT/JP2019/040810 dated Nov. 19, 2019.

(Continued)

*Primary Examiner* — Bernard Rojas
(74) *Attorney, Agent, or Firm* — Shinjyu Global IP

(57) ABSTRACT

An electromagnetic relay includes a pair of fixed terminals, a movable contact piece, and a magnet portion. The pair of fixed terminals includes fixed contact. The movable contact piece that includes a movable contact disposed facing the fixed contact and that is movable in a first direction in which the movable contact contacts the fixed contact and in a second direction in which the movable contact separates from fixed contact. The magnet portion generating a magnetic field for extending an arc generated between the fixed contact and the movable contact. At least one of a corner portion in the first direction side of the fixed terminal located (Continued)

in an arc extension direction in which the arc is extended or a corner portion in the second direction side of the movable contact piece located in the arc extension direction has a chamfered shape in a range where the arc passes through.

9 Claims, 12 Drawing Sheets

(56) References Cited

U.S. PATENT DOCUMENTS

| | | | | |
|---|---|---|---|---|
| 2015/0034600 | A1 | 2/2015 | Isozaki et al. | |
| 2015/0206666 | A1 * | 7/2015 | Naka | H01H 33/60 218/146 |

FOREIGN PATENT DOCUMENTS

| | | | | |
|---|---|---|---|---|
| JP | 2013-222559 | A | | 10/2013 |
| JP | 2015-28934 | A | | 2/2015 |
| JP | 2015028934 | A | * | 2/2015 |
| JP | 6281301 | B2 | | 2/2018 |

OTHER PUBLICATIONS

The Written Opinion of the International Searching Authority of International Application No. PCT/JP2019/040810 dated Nov. 19, 2019.

* cited by examiner

ELECTROMAGNETIC RELAY INCLUDING FIXED TERMINAL HAVING CHAMFERED SHAPE OR MOVABLE CONTACT PIECE HAVING CHAMFERED SHAPE

CROSS-REFERENCE TO RELATED APPLICATION

This application is the U.S. National Phase of International Application No. PCT/JP2019/040810, filed on Oct. 17, 2019. This application claims priority to Japanese Patent Application No. 2018-246970, filed Dec. 28, 2018. The contents of those applications are incorporated by reference herein in their entireties.

FIELD

The present invention relates to an electromagnetic relay.

BACKGROUND

Conventionally, electromagnetic relays that open and close an electric circuit are known. For example, an electromagnetic relay of Japanese Patent No. 6281301 includes a fixed terminal including a fixed contact and a movable contact piece including a movable contact. The movable contact can contact the fixed contact, and the electric circuit is opened and closed when the movable contact contacts the fixed contact or separates from the fixed contact. Further, the electromagnetic relay is provided with a permanent magnet for extending an arc generated when the movable contact separates from the fixed contact (see Japanese Patent No. 6281301). The fixed terminal is formed with a chamfered portion at the end facing the movable contact piece, whereby the arc moves smoothly in a direction away from the fixed contact and the arc is extended.

SUMMARY

In Japanese Patent No. 6281301, since the end of the fixed terminal on the side facing the movable contact piece has an edge shape, so the arc stays at this end. Therefore, it is difficult to smoothly move the arc to the surface of the fixed terminal opposite to the movable contact piece. That is, it is difficult to extend the arc smoothly because a smooth movement of the arc is hindered. Similarly, in Japanese Patent No. 6281301, since the end on the side opposite to the fixed terminal of the movable contact piece has an edge shape, it is difficult to smoothly move the arc to the surface opposite to the fixed terminal of the movable contact piece.

An object of the present invention is to smoothly extend the arc in the electromagnetic relay.

An electromagnetic relay according to one aspect of the present invention includes a pair of fixed terminals, a movable contact piece, and a magnet portion. The pair of fixed terminals includes fixed contact. The movable contact piece includes a movable contact disposed facing the fixed contact. The movable contact piece is movable in a first direction in which the movable contact contacts the fixed contact and in a second direction in which the movable contact separates from the fixed contact. The magnet portion generates a magnetic field for extending an arc generated between the fixed contact and the movable contact. At least one of a corner portion in the first direction side of the fixed terminal located in an arc extension direction in which the arc is extended or a corner portion in the second direction side of the movable contact piece located in the arc extension direction has a chamfered shape in a range where the arc passes through.

In this electromagnetic relay, at least one of the corner portion in the first direction side of the fixed terminal located in an arc extension direction or the corner portion in the second direction side of the movable contact piece located in the arc extension direction is chamfered. Therefore, if the corner portion in the first direction side of the fixed terminal located in the arc extension direction is chamfered, the end of the arc can be moved smoothly to the surface in the first direction side of the fixed terminal when the arc is extended by the magnet portion. Also, if the corner portion in the second direction side of the movable contact piece located in the arc extension direction is chamfered, the end of the arc can be moved smoothly to the surface in the second direction side of the movable contact piece when the arc is extended by the magnet portion. As a result, the arc can be smoothly extended.

Preferably, at least one of a corner portion in the second direction side of the fixed terminal located in the arc extension direction or a corner portion in the first direction side of the movable contact piece located in the arc extension direction has a chamfered shape in the range where the arc passes through. In this case, when the arc is extended by the magnet portion, the end portion of the arc can be smoothly moved to the surface in the first direction side of the fixed terminal or the surface in the second direction side of the movable contact piece. As a result, the arc can be further extended smoothly.

Preferably, the arc can be smoothly moved by forming the chamfer shape into a C-chamfered shape or an R-chamfered shape.

Preferably, at least one of a surface of the fixed terminal located in the arc extending direction or a surface of the movable contact piece located in the arc extending direction has an R shape as a whole in the range where the arc passes through. In this case, the arc can be moved more smoothly.

Preferably, at least one of the fixed terminal or the movable contact piece includes a stop portion that stops the movement of the end of the arc. The stop portion is disposed on the first direction side of the fixed terminal or on the second direction side of the movable contact piece. In this case, the stop portion can intentionally stop the movement of the end portion of the arc. Further, since the stop portion is disposed on the opposite side of the contact, there is little possibility that the extension of the arc is greatly hindered.

Preferably, the fixed terminal includes a first fixed terminal including a first fixed contact which is an anode contact, and a second fixed terminal including a second fixed contact. The movable contact piece includes a first movable contact which is a cathode contact disposed facing the first fixed contact, and a second movable contact disposed facing the second fixed contact. The chamfered shapes of the corner portions in the first direction side and second direction side of the movable contact piece located in the arc extension direction with respect to the first movable contact is formed larger than the chamfered shapes of the corner portions in the first direction side and second direction side of the first fixed terminal located in the arc extension direction with respect to the first fixed contact. In this case, by forming a large chamfer shape on the corner of the movable contact piece where the contact on the cathode side, where the arc is less likely to extend than on the anode side, is located, the end portion of the arc can be smoothly moved to the surface in the first direction side of the movable contact piece.

DETAILED DESCRIPTION

Figure 1:
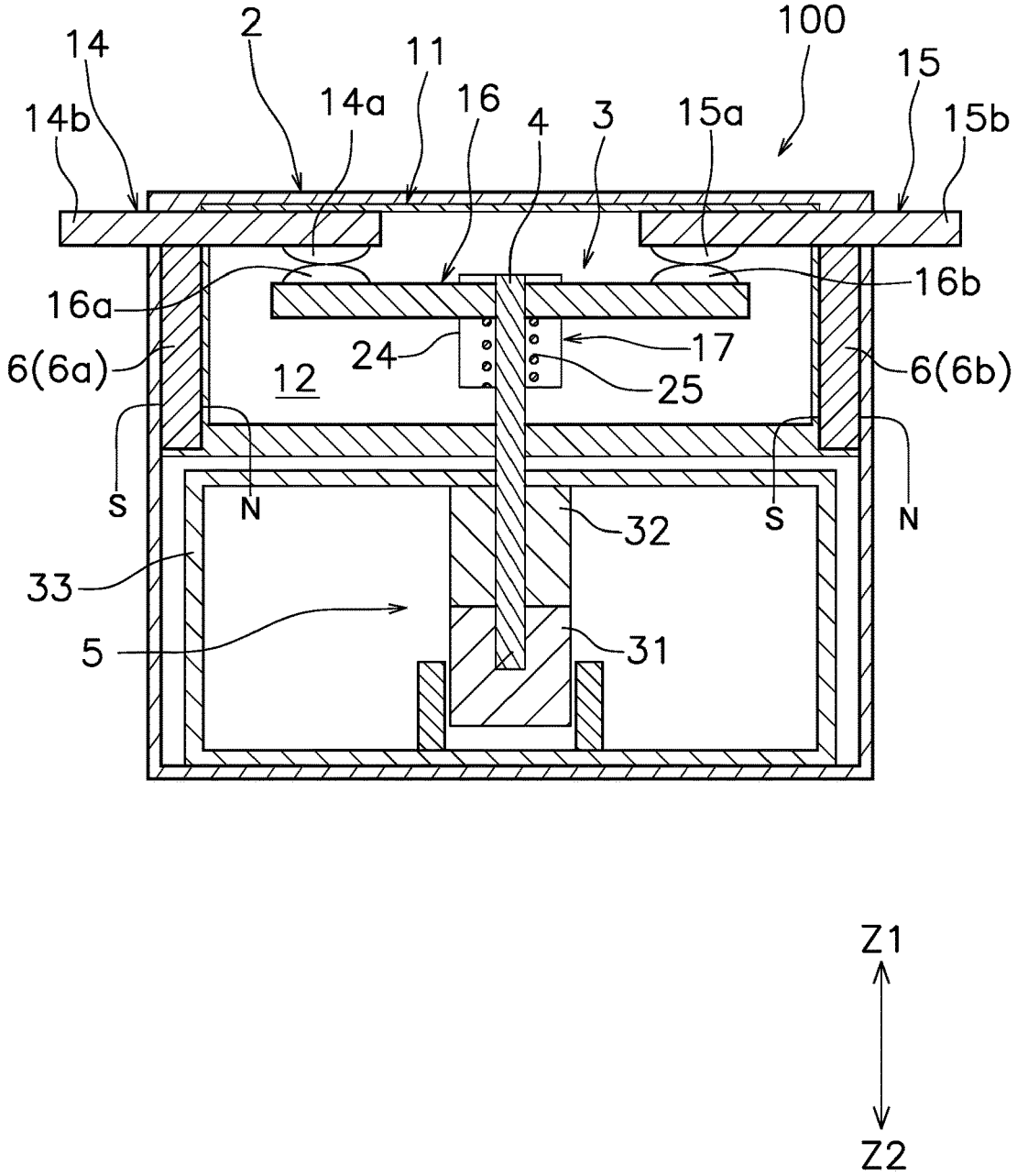
FIG. 1 is a schematic cross-sectional view of an electromagnetic relay.

Hereinafter, embodiments of an electromagnetic relay according to one aspect of the present invention will be described with reference to the drawings. FIG. 1 is a schematic cross-sectional view of an electromagnetic relay 100. As illustrated in FIG. 1, the electromagnetic relay 100 includes a housing 2, a contact device 3, a drive shaft 4, an electromagnetic drive device 5, and a magnet portion 6.

When referring to the drawings, an upper side in FIG. 1 is referred to as "up", a lower side is referred to as "down", a left side is referred to as "left", and a right side is referred to as "right" in order to facilitate understanding of the description. In addition, a direction orthogonal to the paper surface of FIG. 1 will be described as a front-back direction. In this embodiment, a contact direction Z1 is upward in FIG. 1. Further, a separation direction Z2 is downward in FIG. 1. The details of the contact direction Z1 and the separation direction Z2 will be described later.

The housing 2 has a substantially quadrangular box shape and is made of an insulating material. The contact device 3, the drive shaft 4, the electromagnetic drive device 5, and the magnet portion 6 are housed inside the housing 2.

The housing 2 includes a housing portion 11. The housing portion 11 is composed of, for example, a substantially rectangular parallelepiped case member arranged in the housing 2. The housing portion 11 is made of an insulating material.

Figure 2:
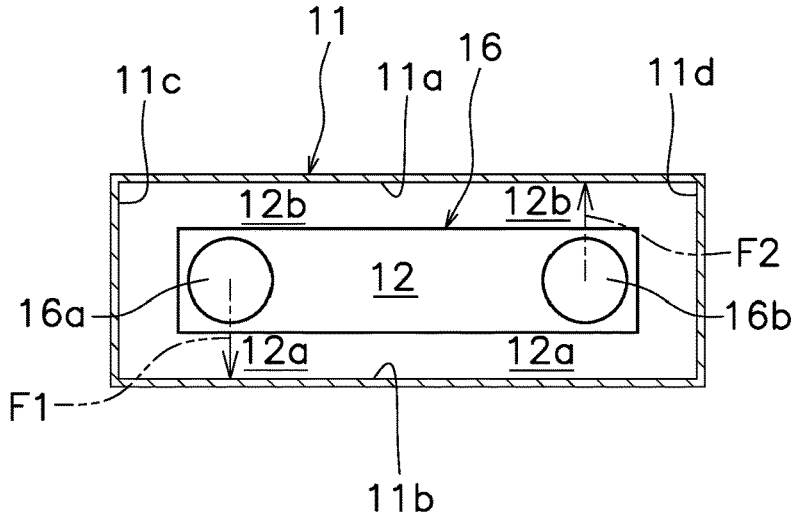
FIG. 2 is a schematic view of an inside of a housing portion as viewed from above.

FIG. 2 is a schematic view of the inside of the housing portion 11 as viewed from above. The housing portion 11 includes a first inner wall surface 11*a*, a second inner wall surface 11*b*, a third inner wall surface 11*c*, and a fourth inner wall surface 11*d*. Each of the first to fourth inner wall surfaces 11*a* to 11*d* is the front, rear, left, and right inner surfaces of the housing portion 11. The first inner wall surface 11*a* and the second inner wall surface 11*b* extend in the up-down direction and the left-right direction. The first inner wall surface 11*a* and the second inner wall surface 11*b* are disposed to face each other in the front-back direction. The third inner wall surface 11*c* and the fourth inner wall surface 11*d* extend in the up-down direction and the front-back direction. The third inner wall surface 11*c* and the fourth inner wall surface 11*d* are disposed to face each other in the left-right direction. The dimensions of the first inner wall surface 11*a* and the second inner wall surface 11*b* in the left-right direction are longer than the dimensions of the third inner wall surface 11*c* and the fourth inner wall surface 11*d* in the up-down direction.

The housing portion 11 includes a housing space 12 for housing the contact device 3. In the present embodiment, the housing space 12 is composed of a substantially rectangular parallelepiped space that is shielded from the outside. The sides of the housing space 12 are surrounded by the first to fourth inner wall surfaces 11*a* to 11*d*.

The contact device 3 includes a first fixed terminal 14, a second fixed terminal 15, a movable contact piece 16, and a contact piece holding portion 17. The first fixed terminal 14, the second fixed terminal 15, and the movable contact piece 16 are made of a conductive material.

The first fixed terminal 14 and the second fixed terminal 15 are plate-shaped terminals and extend in the left-right direction. The first fixed terminal 14 and the second fixed terminal 15 are disposed at a distance from each other in the left-right direction. The first fixed terminal 14 and the second fixed terminal 15 are examples of a pair of fixed terminals.

The first fixed terminal 14 includes a first fixed contact 14*a* and a first external connection portion 14*b*. The first fixed contact 14*a* is disposed in the housing space 12. The first external connection portion 14*b* protrudes leftward from the housing 2 and is exposed to the outside. The second fixed terminal 15 includes a second fixed contact 15*a* and a second external connection portion 15*b*. The second fixed contact 15*a* is disposed in the housing space 12. The second external connection portion 15*b* protrudes rightward from the housing 2 and is exposed to the outside.

As illustrated in FIGS. 1 and 2, the movable contact piece 16 is a plate-shaped member that is long in one direction and extends in the left-right direction in the housing space 12. The movable contact piece 16 is disposed in the housing space 12 at intervals in the front-back direction from the first inner wall surface 11*a* and the second inner wall surface 11*b*. An arc extension space 12*a*, 12*b* for extending an arc is provided between the movable contact piece 16 and the first inner wall surface 11*a*, and between the movable contact piece 16 and the second inner wall surface 11*b*. The arc extension spaces 12*a* and 12*b* are disposed at positions close to the first fixed contact 14*a* and the first movable contact 16*a* described later, or the second fixed contact 15*a* and the second movable contact 16*b* described later.

The movable contact piece 16 is disposed in the housing space 12 at a distance in the left-right direction from the third inner wall surface 11*c* and the fourth inner wall surface 11*d*. The movable contact piece 16 is disposed below the first fixed terminal 14 and the second fixed terminal 15. In the present embodiment, a longitudinal direction of the movable contact piece 16 coincides with the left-right direction. Further, a lateral direction of the movable contact piece 16 coincides with the front-back direction.

The movable contact piece 16 includes a first movable contact 16*a* and a second movable contact 16*b*. The first movable contact 16*a* is disposed to face the first fixed contact 14*a* and can contact the first fixed contact 14*a*. The second movable contact 16*b* is disposed at a distance from the first movable contact 16*a* in the left-right direction. The second movable contact 16*b* is disposed to face the second fixed contact 15*a* and can contact the second fixed contact 15*a*.

The movable contact piece 16 can move in the contact direction Z1 that contacts the first fixed contact 14*a* and the second fixed contact 15*a* and the separation direction Z2 that separates from the first fixed contact 14*a* and the second fixed contact 15*a*. The contact direction Z1 is an example of the first direction, and the separation direction Z2 is an example of the second direction.

The contact direction Z1 is the direction in which the first movable contact 16*a* and the second movable contact 16*b* contact the first fixed contact 14*a* and the second fixed contact 15*a* (upward in FIG. 1). The separation direction Z2 is the direction in which the first movable contact 16*a* and the second movable contact 16*b* separate from the first fixed contact 14*a* and the second fixed contact 15*a* (downward in FIG. 1).

As illustrated in FIG. 1, the contact piece holding portion 17 holds the movable contact piece 16 via the drive shaft 4. The contact piece holding portion 17 connects the movable contact piece 16 and the drive shaft 4. The contact piece holding portion 17 includes a holder 24 and a contact spring 25. The contact spring 25 urges the drive shaft 4 and the movable contact piece 16 toward the contact direction Z1.

The drive shaft 4 extends along the contact direction Z1 and the separation direction Z2. The drive shaft 4 can move together with the movable contact piece 16 in the contact direction Z1 and the separation direction Z2.

The electromagnetic drive device 5 drives the contact device 3. The electromagnetic drive device 5 moves the movable contact piece 16 together with the drive shaft 4 in the contact direction Z1 and the separation direction Z2 by an electromagnetic force. The electromagnetic drive device 5 is disposed below the housing portion 11 in the housing 2.

The electromagnetic drive device 5 includes a movable iron core 31, a fixed iron core 32, and a yoke 33. Further, the electromagnetic drive device 5 includes a coil, a spool, and a coil spring (not illustrated). Since the electromagnetic drive device 5 has the same configuration as the conventional one, detailed description thereof will be omitted.

The magnet portion 6 generates a magnetic field in the housing to extend an arc generated between the first fixed contact 14*a* and the first movable contact 16*a*, and between the second fixed contact 15*a* and the second movable contact 16*b*. Specifically, as illustrated in FIG. 1, the magnet portion 6 includes a first magnet 6*a* and a second magnet 6*b*. The first magnet 6*a* and the second magnet 6*b* are permanent magnets.

The first magnet 6*a* and the second magnet 6*b* extend in the front-back direction and the up-down direction. The first magnet 6*a* and the second magnet 6*b* are fixed to an outer periphery of the housing portion 11 in the present embodiment. The first magnet 6*a* and the second magnet 6*b* are disposed around the housing portion 11 so that different poles face each other in the longitudinal direction of the movable contact piece 16. The N pole of the first magnet 6*a* is disposed facing the housing portion 11. The S pole of the second magnet 6*b* is disposed facing the housing portion 11. The first magnet 6*a* and the second magnet 6*b* disposed in this manner cause a magnetic flux to flow in the housing portion 11 in a direction substantially parallel to the lateral direction of the movable contact piece 16.

Next, the operation of the electromagnetic relay 100 will be described. The operation of the electromagnetic relay 100 is the same as that of the conventional one, it will be briefly described.

FIG. 1 shows a state in which a voltage is applied to the coil. When the voltage is applied to the coil, the movable iron core 31 moves in the contact direction Z1 against an elastic force of the coil spring. With the movement of the contact direction Z1 of the movable iron core 31, the drive shaft 4 and the movable contact piece 16 move in the contact direction Z1, and the first movable contact 16*a* and the second movable contact 16*b* contact the first fixed contact 14*a* and the second and the second fixed contact 15*a*. When the application of the voltage to the coil is stopped, the movable iron core 31 moves in the separation direction Z2 together with the movable contact piece 16 by the elastic force of the coil spring. As a result, the first movable contact 16*a* and the second movable contact 16*b* are in a state of being separated from the first fixed contact 14*a* and the second fixed contact 15*a*. When the first movable contact 16*a* and the second movable contact 16*b* separate from the first fixed contact 14*a* and the second fixed contact 15*a*, an arc is generated between the first movable contact 16*a* and the first fixed contact 14*a*, and between the second movable contact 16*b* and the second fixed contact 15*a*.

Here, as illustrated in FIG. 2, for example, when a current flows from the first fixed contact 14*a* to the first movable contact 16*a*, the Lorentz force F1 acts on the arc generated between the first fixed contact 14*a* and the first movable contact 16*a* in a direction toward the second inner wall surface 11*b*. As a result, the arc is extended in the arc extension space 12*a*. Further, the Lorentz force F2 acts on the arc generated between the second fixed contact 15*a* and the second movable contact 16*b* in a direction toward the first inner wall surface 11*a*. As a result, the arc is extended in the arc extension space 12*b*. When the current flows from the first movable contact 16*a* to the first fixed contact 14*a*, the directions of the Lorentz force F1 and the Lorentz force F2 acting on the arc are opposite to the above-described directions, respectively. In the present embodiment, unless otherwise specified, the direction in which the current flows is described as the direction from the first fixed contact 14*a* to the first movable contact 16*a*.

Figure 3:
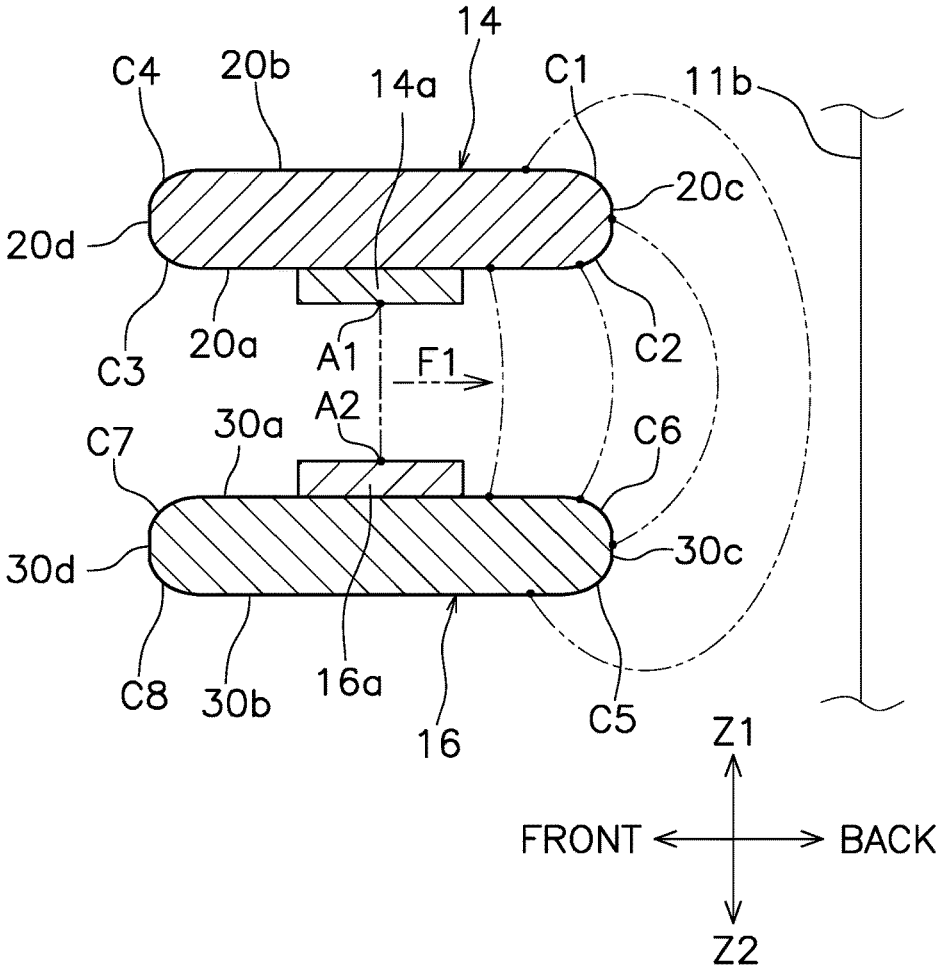
FIG. 3 is a schematic cross-sectional view of a periphery of a first fixed contact as viewed in a direction from a first magnet to a second magnet.

FIG. 3 is a schematic cross-sectional view of the periphery of the first fixed contact 14*a* as viewed in a direction from the first magnet 6*a* to the second magnet 6*b*. FIG. 3 schematically shows how the arc is extended toward the second inner wall surface 11*b* by the Lorentz force F1 acting on the arc.

The first fixed terminal 14 includes a first surface 20*a*, a second surface 20*b*, a third surface 20*c*, and a fourth surface 20*d*. The first surface 20*a* is a surface of the first fixed terminal 14 on the Z2 side in the separation direction. The second surface 20*b* is a surface opposite to the first surface 20*a*, and is a surface on the contact direction Z1 side of the first fixed terminal 14. The first surface 20*a* and the second surface 20*b* extend in the front-back direction and the left-right direction. In the present embodiment, the first surface 20*a* and the second surface 20*b* have a flat shape. The third surface 20*c* is a back side surface of the first fixed terminal 14. The fourth surface 20*d* is a surface opposite to the third surface 20*c*, and is the front side surface of the first fixed terminal 14. The third surface 20*c* and the fourth surface 20*d* extend in the up-down direction and the left-right direction.

The first fixed terminal 14 further includes a first corner portion C1, a second corner portion C2, a third corner portion C3, and a fourth corner portion C4. The first corner portion C1 is located between the second surface 20*b* and the third surface 20*c*. The second corner portion C2 is located between the first surface 20*a* and the third surface 20*c*. The third corner portion C3 is located between the first surface 20*a* and the fourth surface 20*d*. The fourth corner portion C4 is located between the second surface 20*b* and the fourth surface 20*d*.

The first corner portion C1 is an example of a corner portion on the contact direction Z1 side of the first fixed terminal 14 located in the arc extension direction. The second corner portion C2 is an example of a corner portion on the separation direction Z2 side of the first fixed terminal 14 located in the arc extension direction. The arc extension direction means the same direction as the Lorentz force F1 acting on the arc.

The first to fourth corner portions C1 to C4 have a chamfered shape. In the present embodiment, each of the first to fourth corner portions C1 to C4 is R-chamfered, and the first surface 20*a* and the second surface 20*b* are smoothly connected to the third surface 20*c* and the fourth surface 20*d*.

The movable contact piece 16 includes a first surface 30*a*, a second surface 30*b*, a third surface 30*c*, and a fourth surface 30*d*. The first surface 30*a* is a surface of the movable contact piece 16 on the contact direction Z1 side, and faces the first surface 20*a* of the first fixed terminal 14. The second surface 3*b* is a surface opposite to the first surface 30*a*, and is a surface of the movable contact piece 16 on the separation direction Z2 side. The first surface 30*a* and the second surface 30*b* extend in the front-back direction and the left-right direction. In the present embodiment, the first surface 30*a* and the second surface 30*b* have a flat shape. The third surface 30*c* is a back surface of the movable contact piece 16. The fourth surface 20*d* is a surface opposite to the third surface 30*c*, and is a front side surface of the movable contact piece 16. The third surface 30*c* and the fourth surface 30*d* extend in the up-down direction and the left-right direction.

The movable contact piece 16 further includes a fifth corner portion C5, a sixth corner portion C6, a seventh corner portion C7, and an eighth corner portion C8. The fifth corner portion C1 is located between the second surface 30*b* and the third surface 30*c*. The sixth corner portion C5 is located between the first surface 30*a* and the third surface 30*c*. The seventh corner portion C7 is located between the first surface 30*a* and the fourth surface 30*d*. The eighth corner portion C8 is located between the second surface 30*b* and the fourth surface 30*d*. The fifth corner portion C5 is an example of a corner portion on the separation direction Z2 side of the movable contact piece 16 located in the arc extension direction. The sixth corner portion C6 is an example of a corner portion on the contact direction Z1 side of the movable contact piece 16 located in the arc extension direction.

The fifth to eighth corner portions C5 to C8 have a chamfered shape. In the present embodiment, each of the fifth to eighth corner portions C5 to C8 is R-chamfered, and the first surface 30*a* and the second surface 30*b* are smoothly connected to the third surface 30*c* and the fourth surface 30*d*.

The distance from the first fixed contact 14*a* to the second corner portion C2 is about the same as the distance from the first movable contact 16*a* to the sixth corner portion C6. The distance from the first fixed contact 14*a* to the third corner portion C3 is about the same as the distance from the first movable contact 16*a* to the seventh corner portion C7.

Figure 4:
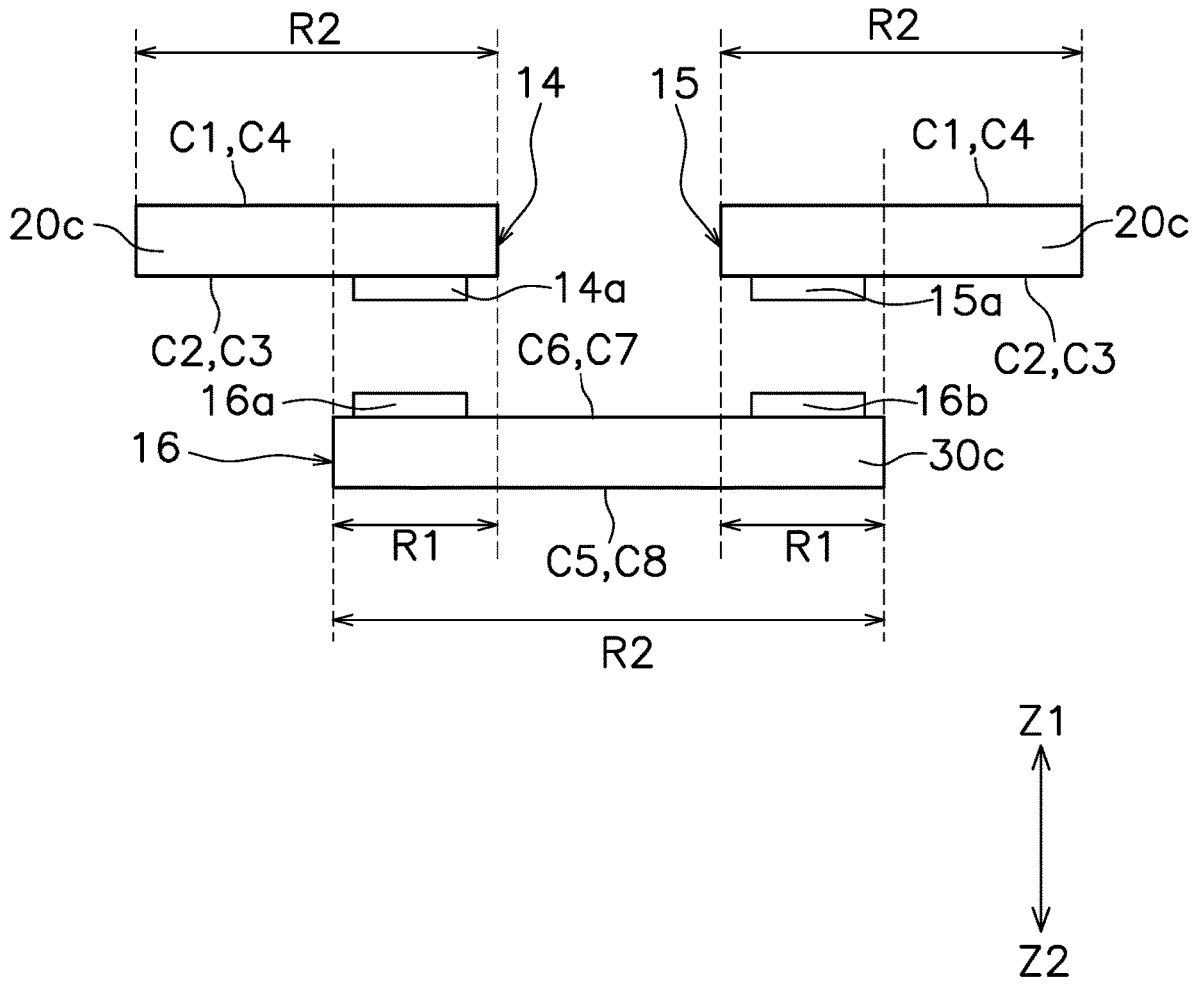
FIG. 4 is a schematic view of a first fixed terminal, a second fixed terminal, and a movable contact piece as viewed from the back toward the rear.

FIG. 4 is a view for explaining a range having a chamfered shape of the first to eighth corner portions C1 to C8, an is a schematic view of the first fixed terminal 14, the second fixed terminal 15, and the movable contact piece 16 as viewed from the back toward the rear. As illustrated in FIG. 4, the first to eighth corner portions C1 to C8 need to have a chamfered shape at least only in a range R1 where the end of the arc passes through, or only in the vicinity of the periphery of the range R1. The range R1 where the end of the arc passes through is, for example, a range close to the first fixed contact 14*a* of the first fixed terminal 14 located in the arc extending direction. Further, it is a range close to the first movable contact 16*a* of the movable contact piece 16 located in the arc extension direction. The first to eighth corner portions C1 to C8 may have a chamfered shape over the entire range R2.

As illustrated in FIG. 3, when the Lorentz force F1 acts on the arc generated between the first fixed contact 14*a* and the first movable contact 16*a*, the arc is extended in the direction toward the second inner wall surface 11*b*. At this time, the end A1 of the arc on the first fixed contact 14*a* side moves from the first fixed contact 14*a* to the second surface 20*b* by passing through the first surface 20*a*, the second corner C2, the third surface 20*c*, and the first corner C1. Further, the end portion A2 of the arc on the first movable contact 16*a* side moves from the first movable contact 16*a* to the second surface 30*b* by passing through the first surface 30*a*, the sixth corner portion C6, the third surface 30*c*, and the fifth corner portion C5.

Here, since the first corner portion C1 and the fifth corner portion C5 have a chamfered shape, when the arc is extended by the Lorentz force F1, the ends A1 and A2 of the arc move smoothly from the first surfaces 20*a* and 30*a* to the second surfaces 20*b* and 30*b*. That is, it is possible to prevent the ends A1 and A2 of the arc from staying at the first corner C1 and the fifth corner C5 and hindering the extension of the arc. As a result, the arc can be extinguished quickly. Further, in the present embodiment, since the second corner portion C2 and the sixth corner portion C6 have a chamfered shape, the ends A1 and A2 of the arc move more smoothly from the first surfaces 20*a* and 30*a* to the second surfaces 20*b* and 30*b*, and the arc can be extinguished quickly.

The second fixed terminal 15 has a symmetrical shape with the first fixed terminal 14 across the drive shaft 4, and the movable contact piece 16 has a symmetrical shape with the drive shaft 4 across the drive shaft 4. Therefore, even in the arc generated between the second fixed contact 15*a* and the second movable contact 16*b*, the same effect as described above can be obtained when the arc is extended by the Lorentz force F2.

Although an embodiment of the electromagnetic relay according to one aspect of the present invention has been described so far, the present invention is not limited to the above embodiment and various modifications can be made without departing from the gist of the invention. For example, the shape or arrangement of the housing 2, the contact device 3, the drive shaft 4, the electromagnetic drive device 5, or the housing portion 11 may be changed.

For example, the first fixed terminal 14 and the second fixed terminal 15 may be bent in a substantially L shape in the housing 2. Further, the first fixed terminal 14 and the second fixed terminal 15 may be disposed below the movable contact piece 16, the electromagnetic drive device 5 may operate to pull the movable contact piece 16 toward the first fixed terminal 14 and the second fixed terminal 15.

In the above embodiment, the magnet portion 6 generates the magnetic field in which the Lorentz forces F1 and F2 act in the direction parallel to the lateral direction of the movable contact piece 16, but the magnet portion 6 generates the magnetic field in which the Lorentz forces F1 and F2 act in the direction parallel to the longitudinal direction of the magnet. In this case, the corners located at both ends of the movable contact piece 16 in the longitudinal direction may have a chamfered shape.

Figure 5:
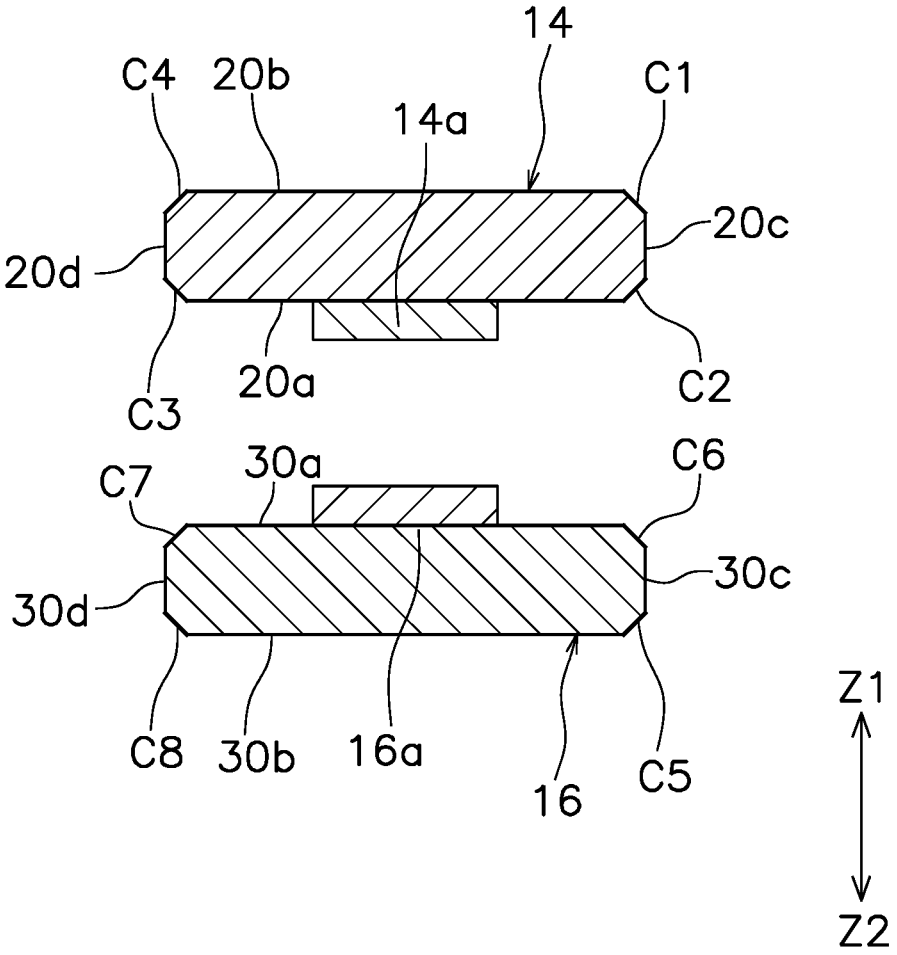
FIG. 5 is a schematic view showing a chamfered shape of a corner portion according to another embodiment.
Figure 6:
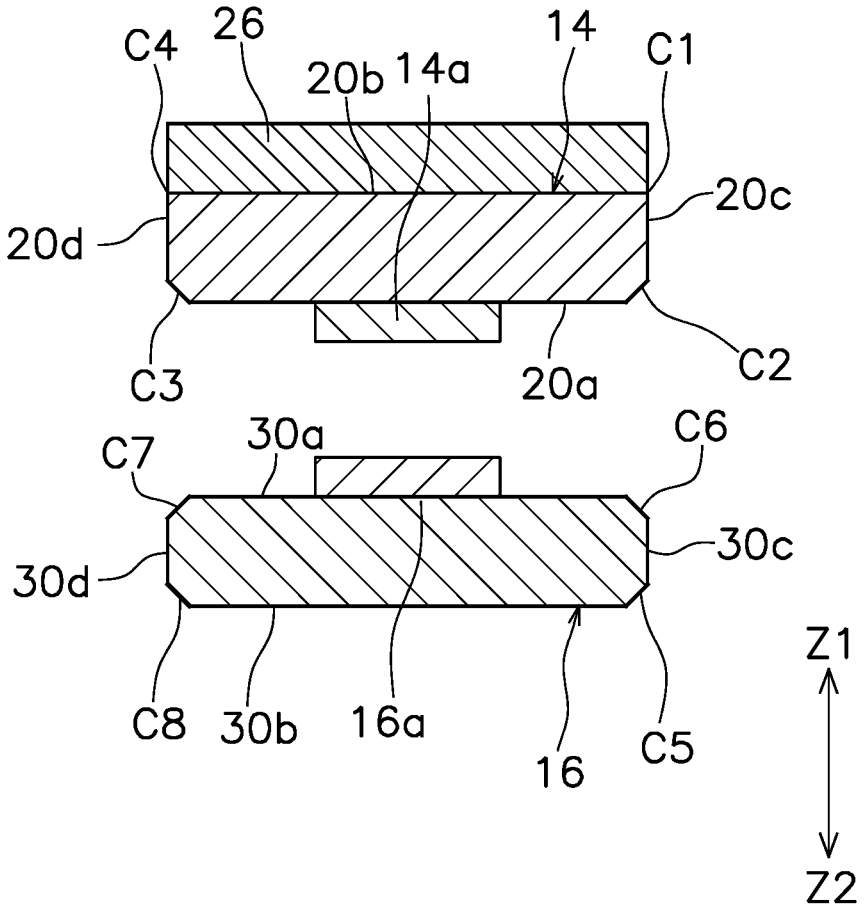
FIG. 6 is a schematic view showing a chamfered shape of a corner portion according to another embodiment.
Figure 7:
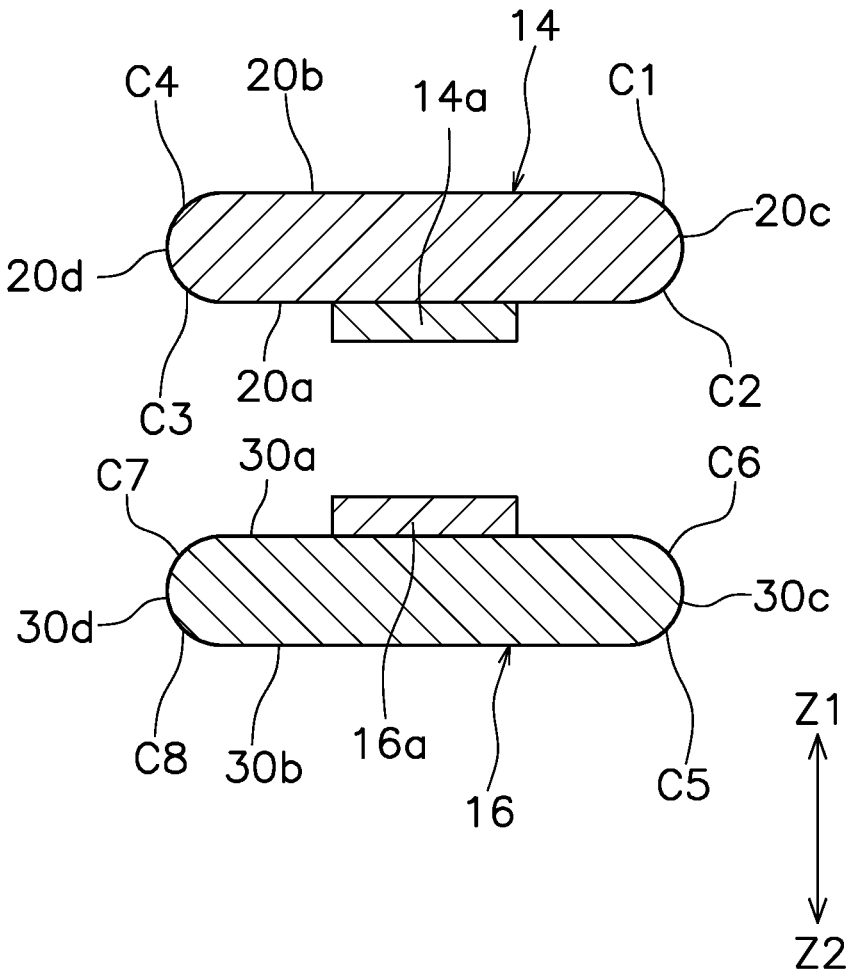
FIG. 7 is a schematic view showing a chamfered shape of a corner portion according to another embodiment.

The chamfered shapes of the first to eighth corner portions C1 to C8 may be formed only at the corner portions located in the arc extension direction. Further, as illustrated in FIG. 5, the chamfered shapes of the first to eighth corner portions C1 to C8 may be a C-chamfered shape. Further, as illustrated in FIG. 6, for example, if another member 26 such as resin is disposed on the second surface 20*b* side of the first fixed terminal 14, and the arc is not be moved to the second surface 20*b* side, the chamfered shapes may be formed only the second corner portion C2 and the third corner portion C3. Further, as illustrated in FIG. 7, the whole of third surface 20*c* and the fourth surface 20*d* may be formed by arc surfaces. Similarly, the whole of third surface 30*c* and the fourth surface 30*d* may be formed by an arc surfaces.

Figure 8:
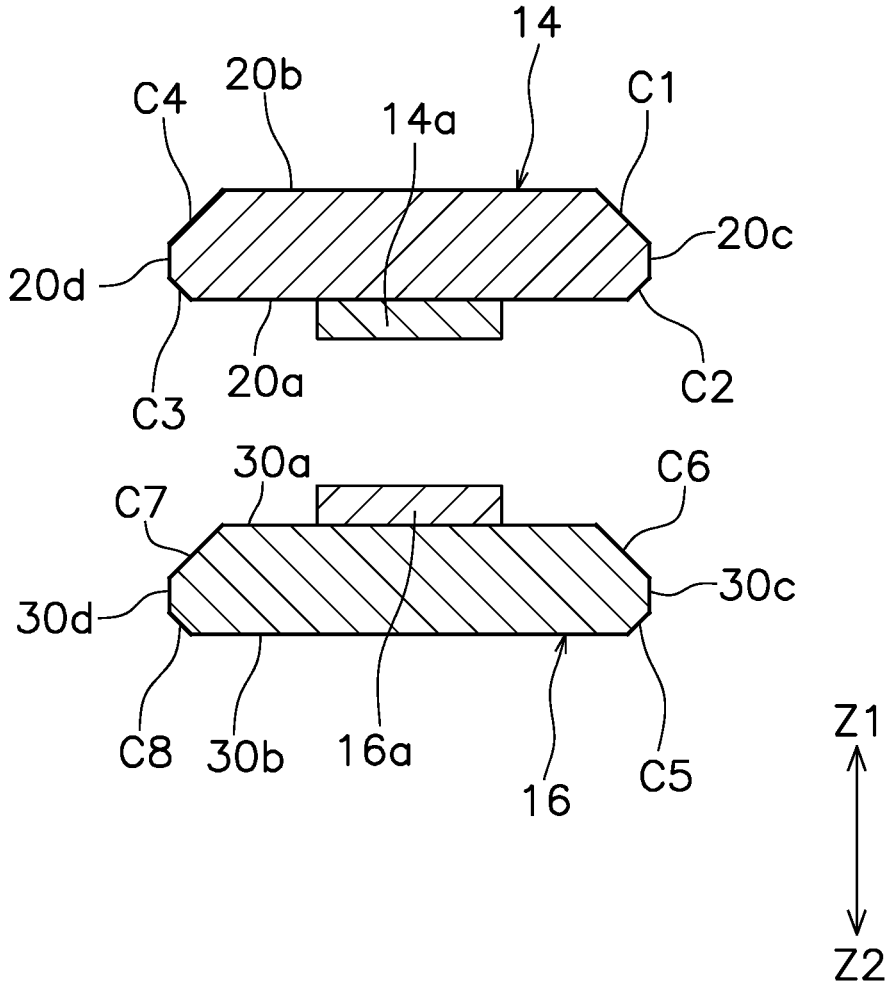
FIG. 8 is a schematic view showing a chamfered shape of a corner portion according to another embodiment.

As illustrated in FIG. 8, the chamfered shapes of the first corner portion C1 and the second corner portion C2 may be different. Similarly, the chamfered shapes of the fifth corner portion C5 and the sixth corner portion C6 may be different. For example, the chamfered shape of one of the first corner portion C1 or the second corner portion C2 may be formed larger than the chamfered shape of the other of the first corner portion C1 or the second corner portion C2.

Figure 9:
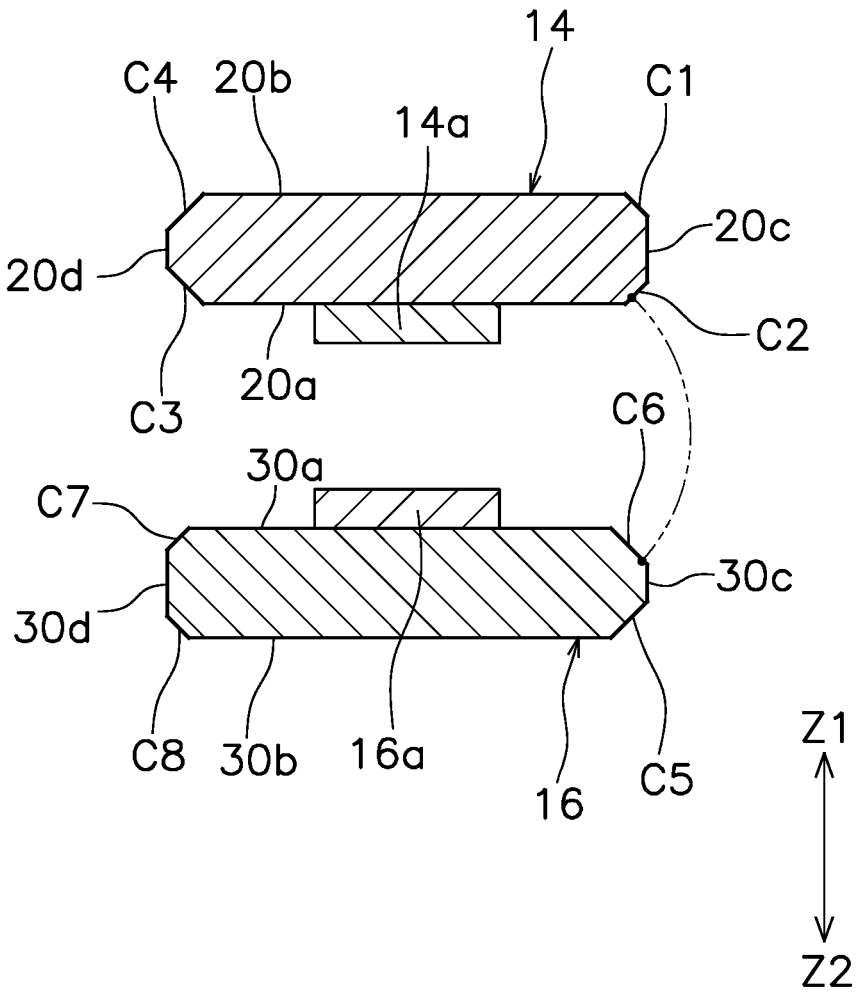
FIG. 9 is a schematic view showing a chamfered shape of a corner portion according to another embodiment.

As illustrated in FIG. 9, when the electromagnetic relay 100 has polarity, the chamfered shape of the contact on the cathode side where the arc is difficult to extend may be formed larger than the chamfered shape of the contact on the anode side. In FIG. 9, for example, the first fixed contact 14*a* is composed of the contact on the anode side and the first movable contact 16*a* is composed of the contact on the cathode side, and the chamfered shapes of the fifth corner portion C5 and the sixth corner portion C6 are formed larger than those of the first corner portion C1 and second corner portion C2. As a result, the end of the arc on the cathode side (first movable contact 16*a* side) smoothly moves from the first surface 30*a* to the second surface 30*b*.

Figure 10:
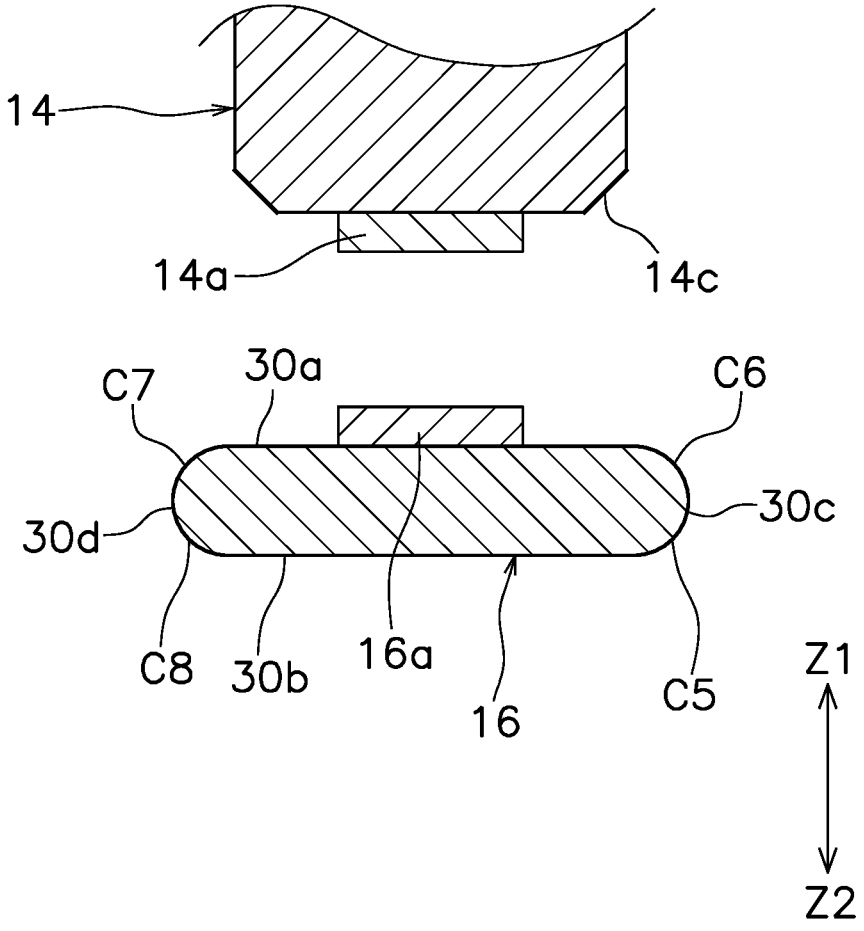
FIG. 10 is a schematic view showing a chamfered shape of a corner portion according to another embodiment.

As illustrated in FIG. 10, the first fixed terminal 14 may be a columnar terminal. In this case, the outer peripheral portion 14*c* of the end surface of the first fixed terminal 14 in the separation direction Z2 side may have a chamfered shape. The second fixed terminal 15 may have the same configuration as the first fixed terminal 14.

Figure 11A:
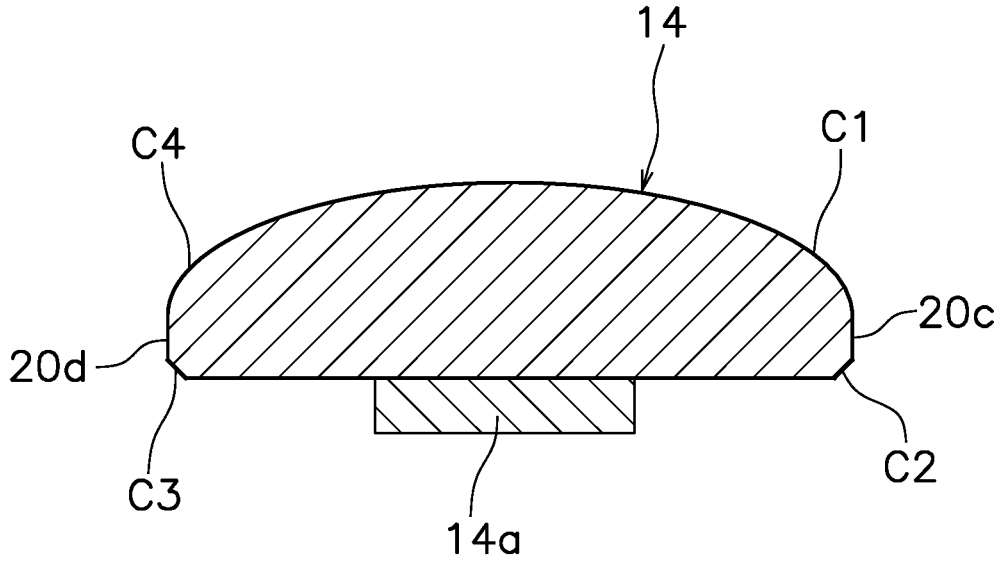
FIGS. 11A and 11B are schematic views showing a chamfered shape of a corner portion according to another embodiment.
Figure 11B:
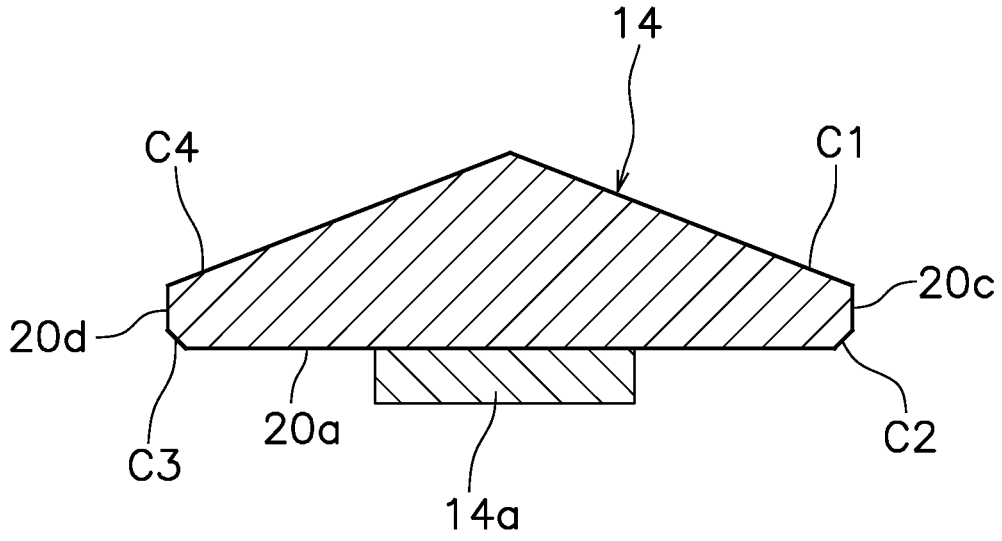

As illustrated in FIGS. 11A and 11B, for example, the chamfered shape of the first corner portion C1 and the chamfered shape of the fourth corner portion C4 may be connected to each other. Specifically, as illustrated in FIG. 11A, the first corner portion C1 and the fourth corner portion C4 may be connected in an arc shape so that the first corner portion C1 and the fourth corner portion C4 are connected to each other. Further, as illustrated in FIG. 11B, the first corner portion C1 and the fourth corner portion C4 are formed in a C-chamfered shape, and one end of the first corner portion C1 and one end of the second corner portion C4 may be connected to each other.

Figure 12:
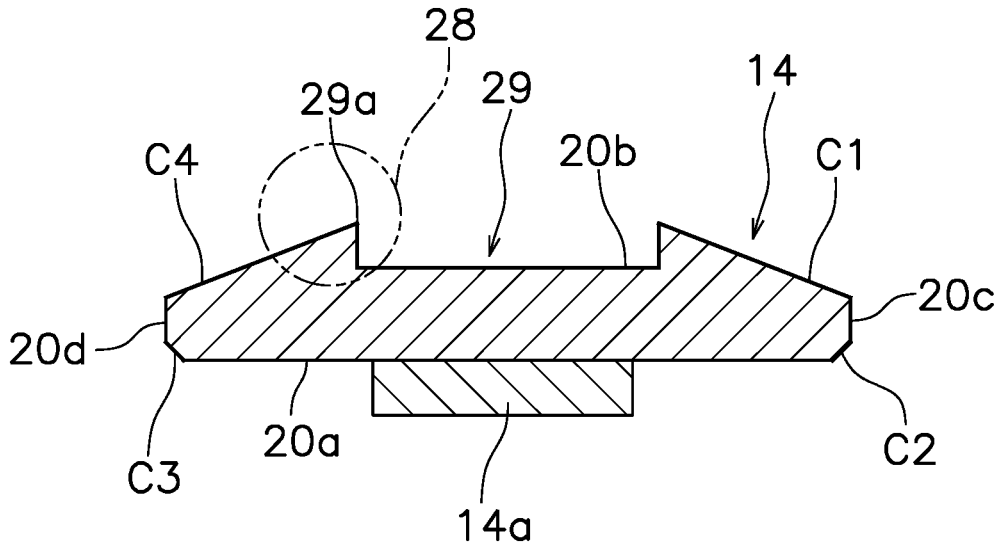
FIG. 12 is a schematic view showing a chamfered shape of a corner portion according to another embodiment.

As illustrated in FIG. 12, for example, if it is desired to stop the movement of the end of the arc at a predetermined position, a stop portion 28 for stopping the movement of the end portion of the arc may be provided. The stop portion 28 may be configured, for example, by a corner portion 29*a* of a recess 29 formed by being recessed in the second surface 20*b* of the first fixed terminal 14. Further, the stop portion 28 may be provided on the second fixed terminal 15 or the movable contact piece 16.

Figure 13A:
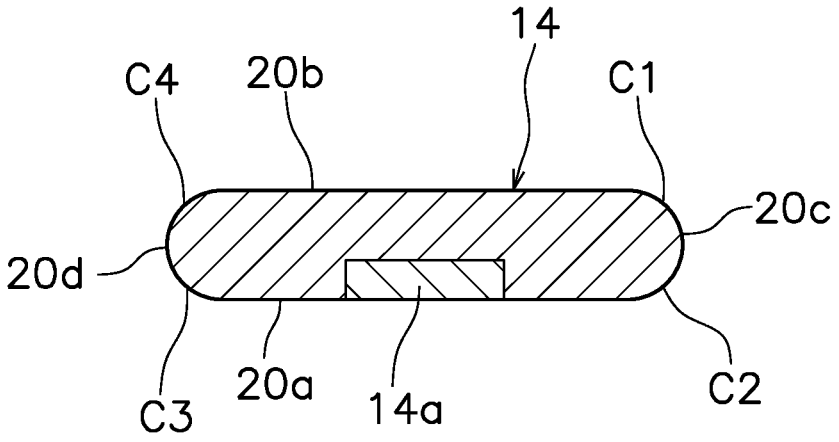
FIGS. 13A and 13B are schematic views showing a chamfered shape of a corner portion according to another embodiment.
Figure 13B:
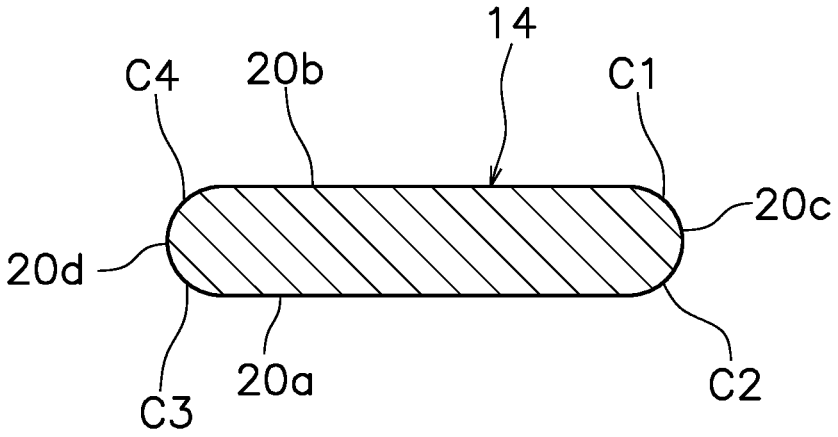

As illustrated in FIG. 13A, the first fixed contact 14*a* may be disposed so as to be flush with the first surface 20*a*. Alternatively, as illustrated in FIG. 13B, the first fixed contact 14*a* may be integrated with the first fixed terminal 14. In this case, the first surface 20*a* of the first fixed terminal 14 contacts the first movable contact 16*a* or the movable contact piece 16. The configuration may be applied to the first fixed terminal 14 or the movable contact piece 16.

REFERENCE NUMERALS

6 Magnet portion
6*a* First magnet
C1 First corner
C2 Second corner
C5 Fifth corner
C6 Sixth corner
14 First fixed terminal
14*a* First fixed contact (example of fixed contact)
15 Second fixed terminal
15*a* Second fixed contact (example of fixed contact)
16 Movable contact piece
16*a* First movable contact (example of movable contact)
16*b* Second movable contact (example of movable contact)
28 Stop portion
100 Electromagnetic relay

The invention claimed is:

1. An electromagnetic relay comprising:

a first fixed terminal including a first fixed contact;

a second fixed terminal including a second fixed contact;

a movable contact piece including a first movable contact disposed facing the first fixed contact and a second movable contact disposed facing the second fixed contact, the movable contact piece being movable in a first direction in which the first movable contact contacts the first fixed contact and in a second direction in which the first movable contact separates from the first fixed contact; and a magnet portion configured to generate a magnetic field for extending an arc generated between the first fixed contact and the first movable contact, wherein at least one of a first-direction-side corner portion on a first direction side of the first fixed terminal located in an arc extension direction in which the arc is extended or a second-direction-side corner portion on a second direction side of the movable contact piece located in the arc extension direction has a chamfered shape in a range where the arc passes through, at least one of the first fixed terminal or the movable contact piece includes a stop portion configured to stop a movement of an end portion of the arc, and the stop portion is disposed on the first direction side of the first fixed terminal or on the second direction side of the movable contact piece, the stop portion forming an acute angle with the chamfered shape.

2. The electromagnetic relay according to claim 1, wherein at least one of a second-side-direction corner portion on a second direction side of the first fixed terminal located in the arc extension direction or a first-direction-side corner portion on a first direction side of the movable contact piece located in the arc extension direction has a chamfered shape in the range where the arc passes through.

3. The electromagnetic relay according to claim 1, wherein the chamfered shape is a C-chamfered shape or an R-chamfered shape.

4. The electromagnetic relay according to claim 1, wherein at least one of a surface of the first fixed terminal located in the arc extension direction or a surface of the movable contact piece located in the arc extension direction has an R shape as a whole in the range where the arc passes through.

5. The electromagnetic relay according to claim 1, wherein the stop portion has an angular shape.

6. The electromagnetic relay according to claim 1, wherein the stop portion is configured by a corner portion of a recess formed by being recessed in a surface on the first direction side of the first fixed terminal or a corner portion of a recess formed by being recessed in a surface on the second direction of the movable contact piece.

7. An electromagnetic relay comprising:

a first fixed terminal including a first fixed contact;

a second fixed terminal including a second fixed contact;

a movable contact piece including a first movable contact disposed facing the first fixed contact and a second movable contact disposed facing the second fixed contact, the movable contact piece being movable in a first direction in which the first movable contact contacts the first fixed contact and in a second direction in which the first movable contact separates from the first fixed contact; and a magnet portion configured to generate a magnetic field for extending an arc generated between the first fixed contact and the first movable contact, wherein the first fixed contact is an anode contact, the first movable contact is a cathode contact, the first fixed terminal includes a first corner portion on a first direction side of the first fixed terminal located in an arc extension direction in which the arc is extended with respect to the first fixed contact, the first corner portion having a chamfered shape in a range where the arc passes through, the movable contact piece includes a second corner portion on a second direction side of the movable contact piece located in the arc extension direction with respect to the first movable contact, the second corner portion having a chamfered shape in a range where the arc passes through, and the chamfered shape of the second corner portion of the movable contact piece is larger than the chamfered shape of the first corner portion of the first fixed terminal.

8. The electromagnetic relay according to claim 7, wherein the first fixed terminal further includes a third corner portion on a second direction side of the first fixed terminal located in the arc extension direction with respect to the first fixed contact, the third corner portion having a chamfered shape in a range where the arc passes through, the movable contact piece further includes a fourth corner portion on a first direction side of the movable contact piece located in the arc extension direction with respect to the first movable contact, the fourth corner portion having a chamfered shape in a range where the arc passes through, and the chamfered shape of the fourth corner portion of the movable contact piece is larger than the chamfered shape of the third corner portion of the first fixed terminal.

9. An electromagnetic relay comprising:

a first fixed terminal including a first fixed contact;

a second fixed terminal including a second fixed contact;

a movable contact piece including a first movable contact disposed facing the first fixed contact and a second movable contact disposed facing the second fixed contact, the movable contact piece being movable in a first direction in which the first movable contact contacts the first fixed contact and in a second direction in which the first movable contact separates from the first fixed contact; and a magnet portion configured to generate a magnetic field for extending an arc generated between the first fixed contact and the first movable contact in a lateral direction of the movable contact piece, wherein the first fixed terminal includes a first corner portion on a first direction side of the first fixed terminal located in one side in the lateral direction and a second corner portion on the first direction side of the first fixed terminal located in another side in the lateral direction, the first and second corner portions having a chamfered shape, the movable contact piece includes a third corner portion on a second direction side of the movable contact piece located in the one side in the lateral direction and a fourth corner portion on the second direction side of the movable contact piece located in the another side in the lateral direction, the third and fourth corner portions having a chamfered shape, the chamfered shape of the third corner portion of the movable contact piece is larger than the chamfered shape of the first corner portion of the first fixed terminal, and the chamfered shape of the second corner portion of the first fixed terminal is larger than the chamfered shape of the fourth corner portion of the movable contact piece.

* * * * *